United States Patent [19]

Johansson

[11] 4,137,661

[45] Feb. 6, 1979

[54] IDENTIFICATION PROCEDURE FOR SUSPENDED ARTICLES OF CLOTHING AND CARRIER FOR APPLICATION OF THE PROCEDURE

[76] Inventor: Gert A. Johansson, von Holtens Vag 21, 443 00 Lerum, Sweden

[21] Appl. No.: 755,631

[22] Filed: Dec. 30, 1976

[30] Foreign Application Priority Data

Jan. 19, 1976 [SE] Sweden ..... 7600493

[51] Int. Cl.[2] ..... G09F 3/14

[52] U.S. Cl. ..... 40/322; 40/2 R; 40/20 R

[58] Field of Search ..... 40/10 R, 322, 20 R, 40/21 R, 2 R

[56] References Cited

U.S. PATENT DOCUMENTS

| | | | |
|---|---|---|---|
| 1,348,952 | 8/1920 | Landry | 40/10 R |
| 1,389,266 | 8/1921 | Newton | 40/322 |
| 2,594,228 | 4/1952 | Smith | 40/322 X |
| 2,775,382 | 1/1957 | Vizza | 40/142 A X |
| 2,825,162 | 3/1958 | Flood | 40/20 R |
| 3,327,419 | 6/1967 | Stanos | 40/124 |
| 3,765,110 | 10/1973 | Olsen | 40/20 R |
| 3,949,914 | 4/1976 | Ostroll | 40/322 X |

*Primary Examiner*—Louis G. Mancene
*Assistant Examiner*—Wenceslao J. Contreras

[57] ABSTRACT

Procedure and device for marking of data distinguishing an article of clothing in respect of size, quality, color, manufacturing data, delivery, pattern, price or other marketing data, etc., on a clotheshanger, the label belonging to the article of clothing and affixed to it close to the hanger by a thread being detachably affixed to the carrier in an easily visible position while remaining secured to the article.

12 Claims, 11 Drawing Figures

Figure 4A:
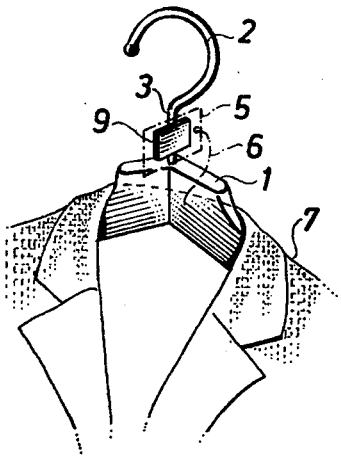

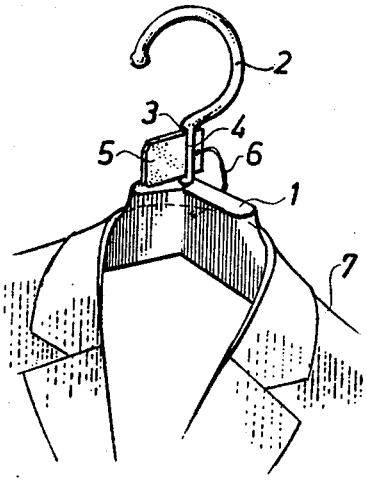
Fig.1B
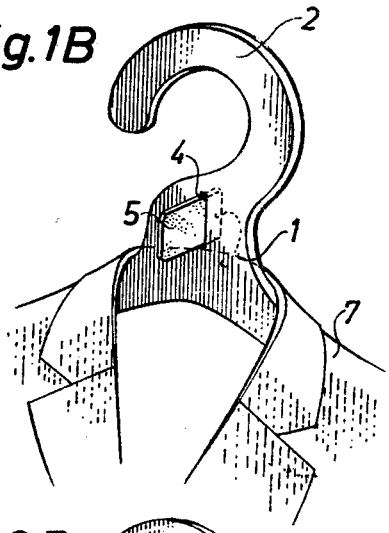
Fig.2A
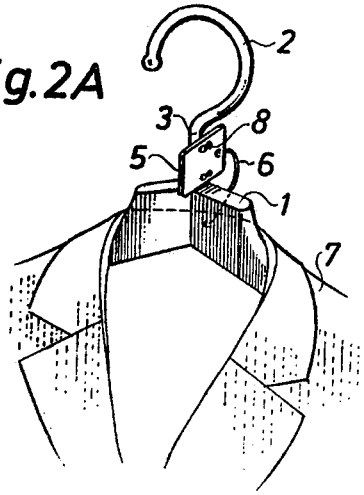
Fig.2B
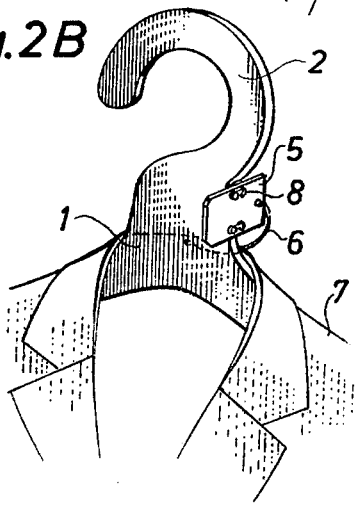
Fig.3A
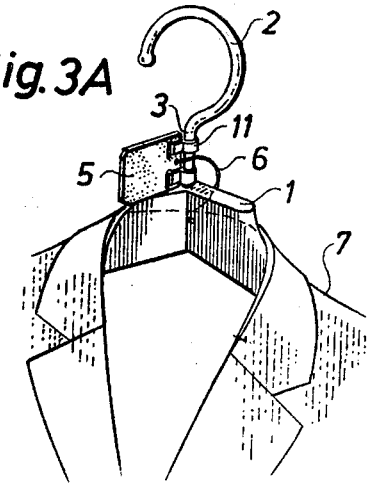
Fig.3B
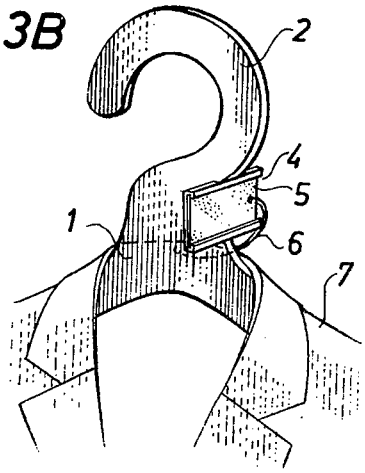

IDENTIFICATION PROCEDURE FOR SUSPENDED ARTICLES OF CLOTHING AND CARRIER FOR APPLICATION OF THE PROCEDURE

A procedure is known for marking of suspended articles of clothing, the clothes-suspending means, for example clotheshangers, being provided with a number of information-carrying, annular marking units with a central hole, forming essentially a round staple, the which marking units are severally passed over a loop to the clothes-suspending means with the aid of the hole and possibly an essentially radial slot uniting the periphery of the unit with the hole, and which on their outside carry information of some kind relating to the article of clothing and together provide the desired easily visible distinguishing of the article as regards size, quality, colour, manufacturing and delivery data, pattern, price or other marketing data, e.g. clearance sale, percent discount etc.

This procedure and the marking units make it possible by means of an easily modifiable combination to mark different production articles, e.g. clothes, for production, stocking or sales purposes. One can, for example, arrange easily surveyable buffer stocks between different manufacturing operations or a main stock in the readymade clothing factory, main stocks in department stores where the article is easily accessible and easily identifiable, showroom and sales stocks where the customer can easily find what he wants in the entire range of stock, etc.

Although by means of an easily modifiable combination it is possible to mark articles of clothing in an extremely efficient way from the aspect of production, stocking and sales technique, it has proved that this procedure cannot render superfluous the marking of articles of clothing with data slips. In addition to the aforesaid marking system, accordingly, one must have data slips or lables securely attached to the articles of clothing.

The object of the present invention is, wherever possible, to use the said data slips in a manner reminiscent of the aforesaid marking procedure.

The procedure according to the invention thus relates also to marking of data distinguishing an article of clothing in respect of size, quality, colour, delivery, pattern, price or other marketing data, etc., on a carrier for the articles, e.g. a clothes-hanger, clothes-peg or the like, and is characterized essentially in that the label attached to the article of clothing is used in such a way that it is secured by a wire, tape or the like, that the attachment to the article is, made close to the carrier, and that the label, while remaining secured to the article by the wire etc., is detachably affixed to the carrier in an easily visible position.

This can be done, for example, by means of clips detachably arranged on the straight portion of the hook of a carrier, by means of which clips the label is secured to said straight portion of the hook or by means of clasps or fasteners on the upper part of a clothes-hanger. In the latter case keyhole-shaped holes or the like must be arranged in the label.

The label can also be secured either to the straight portion of the hook of the hanger or to the upper part of the hanger by providing the label with magnetizable material and the hook or hanger with permanent magnets.

Another method according to the invention is that the label is inserted in a slot either in the straight portion of the hook or in the upper part of the clotheshanger.

Finally, the label may be secured also to an adhesive surface arranged either on the straight portion of the hook or on the upper part of the hanger, for example a flanelograph surface, bur surface or weakly adhesive plastic surface.

The invention also relates to a carrier for articles of clothing, designed in a serviceable manner for implementation of the aforesaid procedure, as will be specified in the device claims.

Figure 1C:
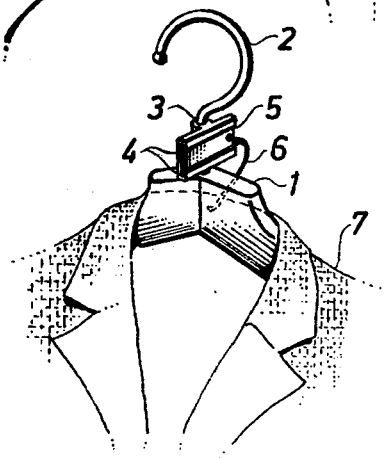

The invention will now be described with reference to the attached drawings, which show the following:

FIG. 1A a carrier with a hook, the straight portion of which contains a slot in which is inserted a label secured to an article of clothing, FIG. 1B the upper part of a hanger having a slot in which is inserted a label secured to an article of clothing, FIG. 1C a carrier with a hook, on the straight portion of which is affixed a plate having two grooves in which a label is inserted, FIG. 2A the hook of a carrier for articles of clothing, the straight portion of which is furnished with two clasps to which is fitted a label by means of two key-shaped eyelets in the label, FIG. 2B the upper part of a carrier for articles of clothing, having two clasps to which a label with corresponding cut-outs can be fitted.

FIG. 3A a hook of a carrier on the straight portion of which are clips in which a label is inserted, FIG. 3B the upper portion of a carrier on the surface of which are two grooves spaced at a distance slightly less than the width of a label, with a label inserted in the grooves.

Figure 4B:
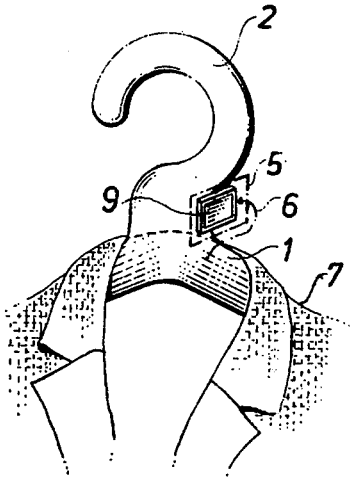
Figure 5A:
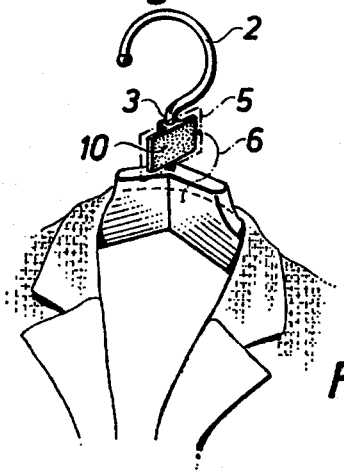
Figure 5B:
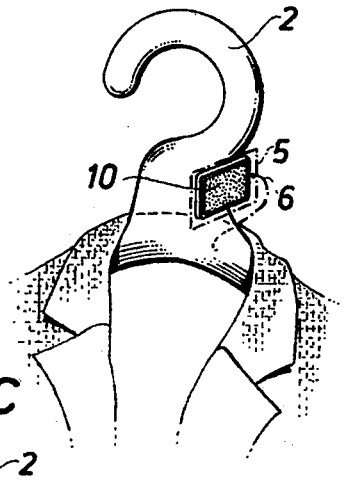

FIG. 4A the hook of a clotheshanger with a permanent magnet attached to the straight portion of the hook, the magnet carrying a label furnished with magnetic material, FIG. 4B the upper part of a clotheshanger in which a permanent magnet is so embedded that a label furnished with magnetic material adheres to its front surface, FIG. 5A the hook of a carrier on the straight portion of which is a fastening surface, e.g. a flanel surface or bur surface, to which a label with corresponding surface is attached, FIG. 5B the upper part of a carrier on the front surface of which is arranged a flanel- or bur-coated surface or possibly a surface with some slightly adhesive plastic.

As appears fron FIGS. 1A, 1B and 1C, these embodiments show that either the straight portion 3 of the hook 2 of the carrier or the upper part 1 of the carrier has been provided with a slot 4 or a plate with two grooves 4, in the which slot or grooves is inserted a label 5 which is suspended by a wire or string 6 in an article of clothing 7. In this way the requirement is fulfilled that the label 5 shall be affixed to the article of clothing 7 and that the latter, for example a suit, shall by a glance at the hanger be immediately identifiable in respect of size, quality of cloth, manufacturing and delivery data, price etc.

In FIGS. 2A and 2B is shown another embodiment of the invention in which two keyhole-shaped cut-outs have been made in the label 5 and the straight portion 3 of the hook or the upper part 1 of the carrier has been provided with two clasps 8 which fit into said holes. In this way a label 5 can be made to sit well visibly either on the hook 2 or on the actual hanger at the same time as it is affixed by a wire or a string 6 to the article of clothing 7, which may consist of a suit, a dress, stockings or other footwear.

FIGS. 3A and 3B show another variant of the invention in which the label 5 has been inserted either in two clips 11 on the straight portion 3 of the hook or in two grooves 4 in the upper part 1 of the hanger, the which grooves may be spaced at a distance slightly less than the width of the label 5. In this case as well the label 5 sits well visible and possibly slightly cupped on the hanger.

In the embodiment of the invention shown in FIGS. 4A and 4B either the straight portion 3 of the hook has been furnished with a permanent magnet 9 which may be clamped to the hook 2 or glued to it, or a permanent magnet 9 has been embedded in the upper part 1 of the hanger if the hanger is of plastic, or a permanent magnet 9 has been attached to it in a similar manner to its attachment to the hook 2. This provides on the hook 2 or the hanger a magnetic adhesive surface to which a label 5 treated with iron filings or iron oxide can be made to adhere.

FIGS. 5A and 5B, finally, show an embodiment of the invention in which either the straight portion 3 of the carrier hook or the upper part 1 of the hanger has been given an adhesive surface 10. The adhesive surface may be either a flannel surface to which a likewise flanelled surface of the label 5 can be made to adhere or the two surfaces may be covered with bur-like cloth or velvet, in which case adhesion of the label 5 is also possible, or, finally, the two surfaces can be coated with weakly adhesive plastic, which also provides the necessary fastening.

In this way the identification which the label 5 provides can be arranged fully visibly on the carrier of the article of clothing 7 during the whole manufacturing process and also during stocking, distribution and sale, without it being detached from the article of clothing 7.

Although the invention has been described with reference to some of its embodiments, it can nevertheless be arbitrarily varied within the scope of the following claims.

What is claimed is:

1. A marking system for articles of clothing comprising in combination: a hanger having a first portion adapted to hold an article of clothing and a second portion extending upwardly therefrom for attachment to a fixed support; a tag holder located on the upper portion of said hanger at a location above the level at which the article of clothing is supported thereon, a tag adapted to have selected information thereon relating to an article of clothing; said tag holder and said tag having means cooperatively securing said tag to said tag holder during normal handling of said hanger and permitting removal thereof manually, said tag having an elongated flexible tie element secured at one end thereof to said tag and means at the other end adapted to be secured to an article of clothing to which it refers.

2. A marking system according to claim 1, wherein said tag holder comprises a slot formed in said hanger and said tag is dimensioned to be slidably positioned within said slot.

3. A marking system according to claim 1, wherein said tag holder comprises at least one clip member secured adjacent one end thereof to said hanger and adapted at the other end thereof to releasably grasp said tag.

4. A marking system according to claim 1, wherein said tag holder is at least partially in the form of a permanent magnet and said tag is provided with magnetizable material.

5. A marking system according to claim 1, wherein said tag holder and said tag are provided with cooperable adhesive surfaces.

6. A marking system according to claim 1, wherein said tie element comprises a wire.

7. A marking system according to claim 1, wherein said tie element comprises a tape.

8. A method of marking articles of clothing with data and of displaying the articles and data, comprising: providing a hanger support having a tag holder thereon on the upper portion thereof at a location above the level at which the article of clothing is supported thereon, affixing a tag having selected information thereon relating to an article of clothing on the article of clothing by means of an elongated flexible tie element, the tag being carried at one end of the tie element and the other end of the tie element being secured to the article of clothing at a location thereon to be closely proximate to said tag holder when the article of clothing is disposed on the hanger, and supporting the article of clothing on the hanger support and mounting said tag releasably on said tag holder such that the information thereon is readily visible.

9. A method according to claim 8, wherein said tag is mounted on said tag holder by inserting said tag through a slot in the hanger support which comprises the holder.

10. A method according to claim 8, wherein said tag and holder are brought into releasable engagement magnetically.

11. A method according to claim 8, wherein said tag is adhesively connected to said holder.

12. A method according to claim 8, wherein said tag is grasped by said holder which comprises a clip.

* * * * *